United States Patent [19]

Mitten

[11] Patent Number: 4,821,158

[45] Date of Patent: Apr. 11, 1989

[54] PRE-FRAMED LIGHTING SYSTEM FOR WINDOWS OR DOORS

[76] Inventor: James L. Mitten, 51 Beech Dr., Apt. A-2, Baltimore, Md. 21220

[21] Appl. No.: 157,586

[22] Filed: Feb. 19, 1988

[51] Int. Cl.[4] ..... F21V 21/00

[52] U.S. Cl. ..... 362/249; 362/125; 362/806

[58] Field of Search ..... 362/125, 145, 226, 806, 362/250, 249

[56] References Cited

U.S. PATENT DOCUMENTS 4,128,863 12/1978 Premetz ..... 362/806 X
4,335,422 6/1982 Van Ess ..... 362/806 X
4,357,653 11/1982 Kovacs ..... 362/250 X
4,482,944 11/1984 Roossine et al. ..... 362/250 X

*Primary Examiner*—Stephen F. Husar
*Attorney, Agent, or Firm*—Walter G. Finch

[57] ABSTRACT

An improved assembly of rectangular frame carrying a strand of inward-pointing Christmas tree lights includes a shoulder in the inner end of each hole for a light, limiting inward travel of the light on simple assembly in which the lights and sockets are pushed through from the outside; for instant assembly/disassembly an elastomeric band around the outer perimeter in a groove in the frame retains all lights and can help retain the assembly in a window frame, if desired, together with one or more plunger type retainers.

8 Claims, 1 Drawing Sheet

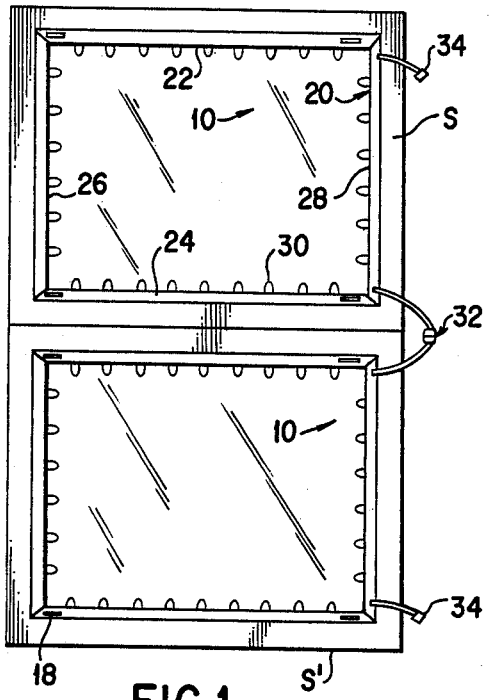
FIG. 1
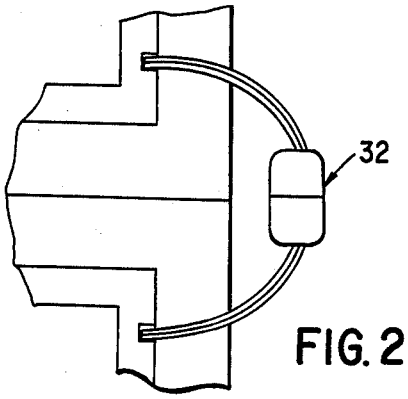
FIG. 2
FIG. 4
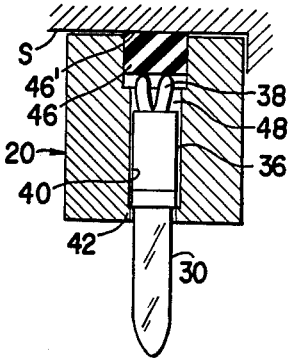
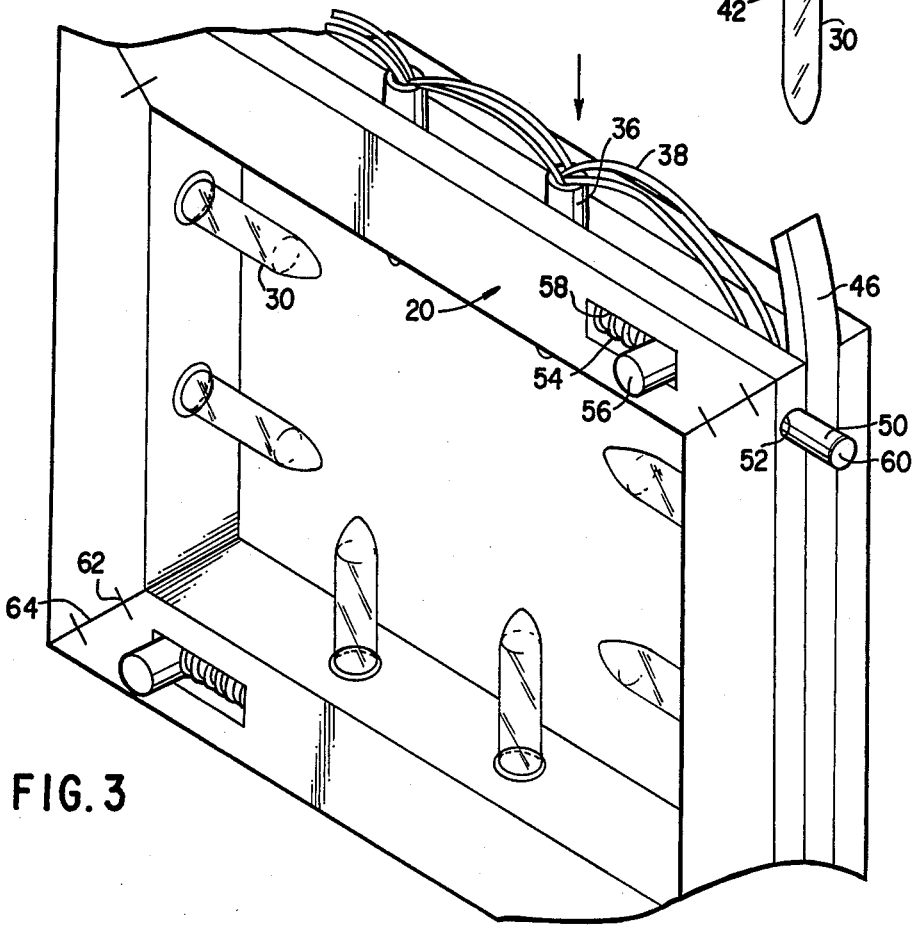
FIG. 3

PRE-FRAMED LIGHTING SYSTEM FOR WINDOWS OR DOORS

FIELD OF THE INVENTION

This invention relates generally to illumination and specifically to pre-framed lighting systems ready to slip into windows or doors. This patent application is a refile of my U.S. patent application, Ser. No. 674,414 filed Nov. 23, 1984 for "Pre-Framed Lighting System for Windows or Doors" and now abandoned.

The following U.S. patents relate to the field of the invention:

U.S. Pat. No. 4,357,653 issued on Nov. 2, 1982, to M. J. Kovacs which discloses a Christmas Light Frame for insertion into a window and having grooves for wires and openings for holding lights pointing inwards;

U.S. Pat. No. 3,569,691 issued on Mar. 9, 1971 to R. F. Tracy which discloses a light channel structure which can be used around buildings; and U.S. Pat. No. 3,500,036 issued on Mar. 10, 1970 to J. S. Szentveri which discloses in FIG. 1*a* strip lighting element with a series of lights in holes through it.

SUMMARY OF THE INVENTION

The general type inventions disclosed in the above referenced U.S. Pat. No. 4,357,653 is that of a rectangular frame bearing a plurality of inward pointing electric lights, and produces both a useful and an ornamental illumination.

Window framing lights in general can be seen from both outside and inside the window, and have become adopted especially for Christmas decorating.

Two types are known, namely the free string type which requires laborious and to some possible extent destructive tacking in place along window frames, and the self-supported type represented by U.S. Pat. No. 4,357,653 patent.

The obvious choice for ease and speed of installation and removal and storage is the self-supporting type. However, severe disadvantages of the self-supporting type are the cost, single purpose, moisture and dirt trapping, difficulty of assembly and of bulb replacement, difficulty of adjustment, and difficulty of drying and cleaning.

A principal object of this invention, therefore is to provide an instant-assembly/disassembly window light system as described which employs an ordinary string of tubular Christmas tree lights.

Another object of this invention is to provide an instant-assembly/disassembly light system which is easier to assemble and to replace bulbs in than known systems of the type.

Other objects of this invention is to provide an instant-assembly/disassembly window light system which is easier to adjust, easier to clean, easier to dry, and yet is at the same time less expensive.

Still other objects of this invention is to provide a window light system which is simpler and more versatile and resiliently adapted for inside or for outside installation in a building.

BRIEF DESCRIPTION OF THE DRAWINGS

The above and other objects and advantages of this invention will become more readily apparent on examination of the following description, including the drawings in which like reference numerals refer to like parts.

FIG. 1 is a front elevational view of a two-system installation in a window;

FIG. 2 is an enlarged detail of the connection between the two systems of FIG. 1;

FIG. 3 is a sectional detail taken at 3—3, FIG. 1; and

FIG. 4 is an enlarged exaggerated fragmentary perspective detail of part of a system.

DETAILED DESCRIPTION

FIG. 1 shows the invention in preferred embodiment installed, one of the units 10 being in place in all conventional window sash S and the other of the units 10 being in place in a conventional lower window sash S'. Plunger-type slide clamps 18 may hold each unit in place.

Each unit is in the form of a rectangular frame 20 with top 22, bottom 24 and sides 26, 28, each having an inwardly-protruding series of regularly spaced Christmas tree type electric lights 30.

A detachable electrical connection 32 may connect the two units 10. A respective extension or line cord attachment 34, 36 may be provided for each unit 10, so that either can be conventionally coupled to a convenience outlet, or optionally only one unit 10 can be proved with a line cord attachment, but identical units 10 are preferable.

FIG. 2 is an enlarged detail of the connection 32 between the units 10. This is preferably a commercial type rotary-lock symmetrical, detachable connection so that the halves of the connector are identical and either side of the connector may be the electrically "hot" side without exposing the terminals. The leads may be short as indicated but there is no limitation on extra length.

Referring to FIG. 3, there is shown the relation of parts providing superior mechanism and function in this invention over what was known before. Each light 30 is a conventional Christmas tree light of a string of such lights, parallel-connected in a respective socket 36 with the other lights in the system by means of insulated wires 38, all in conventional manner normally as provided in a Christmas tree light set.

Each one of the lights 30 protrudes inwardly through a respective hole 40 with a shoulder 42 at the inner end. The shoulder 42 engages the light socket 36, which slides in a coaxial counterbore 44 in the frame, forming the shoulder 12, and prevents the lights 30 from being forced inwardly past the proper length.

Forcing the lights 30 inwardly is an elastomeric band 46 which lies in a peripheral groove 48 in the frame 20 and bears on the wires 38 and therefore on the sockets and lamps, effectively. Any excess of wire is merely folded in the groove.

The elastomeric band 46 is continuous and preferably is sized to extend between the walls of the groove and form a moisture seal along the groove preventing moisture penetration from above.

Protrusion 46' of the elastomeric band outwardly from the groove also helps retain the frame 20 in a window frame opening by resiliently bearing on the window frame S.

FIG. 4 diagrams in exaggerated-size detail how the installation is made, lamps 30 shown at the bottom and side being fully installed and sockets 36 and wires 38 being in process of installation, the arrow indicating that they are merely pushed axially into place for installation, and then resiliently retained there by the elastomeric band 46 (shown fragmentarily). This resilient retention can permit some degree of axial retraction if accidentally struck, and prevent breakage.

Also shown in more detail are the optional plunger-type slide clamps 18, each of which is a dowel 50 sliding in a hole 52 under force of a spring 54 on the butt end of the dowel bearing on a handle 56 protruding from a handle-slot 58 and also bearing on the inner end of the handle-slot. The outer end of the dowel 50 may have a resilient pad 60 for non-scarring contact in bearing outward for better securance in a window frame 20. The plunger type slide clamp is offset to one face as shown to clear the rubber or other elastomeric band 46.

If desired, the frame 20 may be of wood connected by staples across the mitre corner 64, or may be of aluminum or brass conventionally connected. Size may be suitable to fit the opening in window or door, cross-section may be as little as $\frac{3}{4}\times$182 inch (18×18 mm) or as great as desired in larger openings, within the spirit of the invention. Plastic can also be used.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed is:

1. In combination, a system having a rectangular frame for fitting in a window recess and for positioning a string of Christmas tree type lights inward facing in apertures in said frame for receiving respective sockets holding said lights, said string of lights including wiring connecting said sockets, said frame defining each said aperture as a hole through said frame from the outer side to the inner side and proportioned for passage of a said light therethrough, and a shoulder in each said hole proportioned for restraining a said socket from passing therethrough, and means for quick assembly of said string of lights to said frame by passing lights in sockets axially inward to an inward position from outside said frame, and means for retaining all said lights together at said inward position.

2. In the combination as recited in claim 1, said means for retaining all said lights being resilient.

3. In the combination as recited in claim 2, said means for resiliently retaining all said lights includes an elastomeric band positioned around said frame.

4. In the combination as recited in claim 3, wherein said elastomeric band is positioned in a peripheral groove in said frame.

5. In the combination as recited in claim 4, wherein said elastomeric band is continuous.

6. In the combination as recited in claim 4, wherein said elastomeric band is proportioned for sealing said groove.

7. In the combination as recited in claim 4, wherein said elastomeric band is proportioned for partially protruding outwardly from said frame for fitting said frame resiliently in a said window recess.

8. In combination as recited in claim 1, and additionally at least one plunger-type resiliently biased clamp positioned in said frame for detachably fixing said frame in a said window recess.

* * * * *